US006504318B1

(12) United States Patent
Pienisaari

(10) Patent No.: US 6,504,318 B1
(45) Date of Patent: Jan. 7, 2003

(54) SUPPLY COUPLING OF A FLUORESCENT LAMP

(75) Inventor: Heikki Pienisaari, Mäntsälä (FI)

(73) Assignee: Innoware Oy, Lahti (FI)

( * ) Notice: Subject to any disclaimer, the term of this patent is extended or adjusted under 35 U.S.C. 154(b) by 0 days.

(21) Appl. No.: 09/701,327

(22) PCT Filed: Mar. 29, 2000

(86) PCT No.: PCT/FI00/00269

§ 371 (c)(1),
(2), (4) Date: Jan. 25, 2001

(87) PCT Pub. No.: WO00/59273

PCT Pub. Date: Oct. 5, 2000

(30) Foreign Application Priority Data

Mar. 30, 1999 (FI) ..... 990706

(51) Int. Cl.[7] ..... H05B 41/24; H05B 41/36

(52) U.S. Cl. ..... 315/242; 315/219; 315/120

(58) Field of Search ..... 315/120, 129, 315/291, 307, DIG. 2, DIG. 4, DIG. 5, 242, 219, 223, 226, 243; 323/355, 358, 359, 247

(56) References Cited

U.S. PATENT DOCUMENTS

| | | | | |
|---|---|---|---|---|
| 5,023,519 A | * | 6/1991 | Jensen | 315/219 |
| 5,422,545 A | * | 6/1995 | Felper et al. | 315/209 R |
| 5,796,216 A | * | 8/1998 | Beasley | 315/224 |
| 5,854,538 A | * | 12/1998 | Krummel | 315/102 |

FOREIGN PATENT DOCUMENTS

| | | |
|---|---|---|
| EP | 0681414 | 5/1995 |
| EP | 0696157 | 8/1995 |
| EP | 0852453 | 7/1998 |
| EP | 0886460 | 12/1998 |
| FI | 101188 | 4/1998 |
| FI | 102347 | 11/1998 |
| WO | WO 00/59271 | 10/2000 |

* cited by examiner

*Primary Examiner*—Don Wong
*Assistant Examiner*—Chuc D Tran
(74) *Attorney, Agent, or Firm*—Leydig, Voit & Mayer, Ltd.

(57) ABSTRACT

The invention relates to a supply coupling of a fluorescent lamp used for supervising the operation and condition of a lamp circuit, particularly a supply coupling in connection with an electronic coupling device wherein the power required by the lamp circuit is supplied to the coupling by a transformer. The supply coupling comprises a supply transformer (T1), a resonance circuit comprising the secondary coil (N2) of the transformer (T1) and a capacitor (C1) connected in parallel with the secondary coil, and a fluorescent tube (Lamp 1) connected in parallel with the resonance circuit and comprising fluorescent cathodes (F1, F2). The coupling further comprises a direct-current supply (DC) arranged to supply direct current ($I_{DC}$) through a circuit comprising a first fluorescent cathode (F1) of the fluorescent tube, a secondary coil (N2) of the supply transformer (T1), a second fluorescent cathode (F2) of the fluorescent tube (Lamp 1) and an indicator circuit (A) arranged to detect the presence of said direct current ($I_{DC}$) and to generate a signal indicating that presence to be used for controlling a coupling device of the fluorescent lamp.

2 Claims, 1 Drawing Sheet

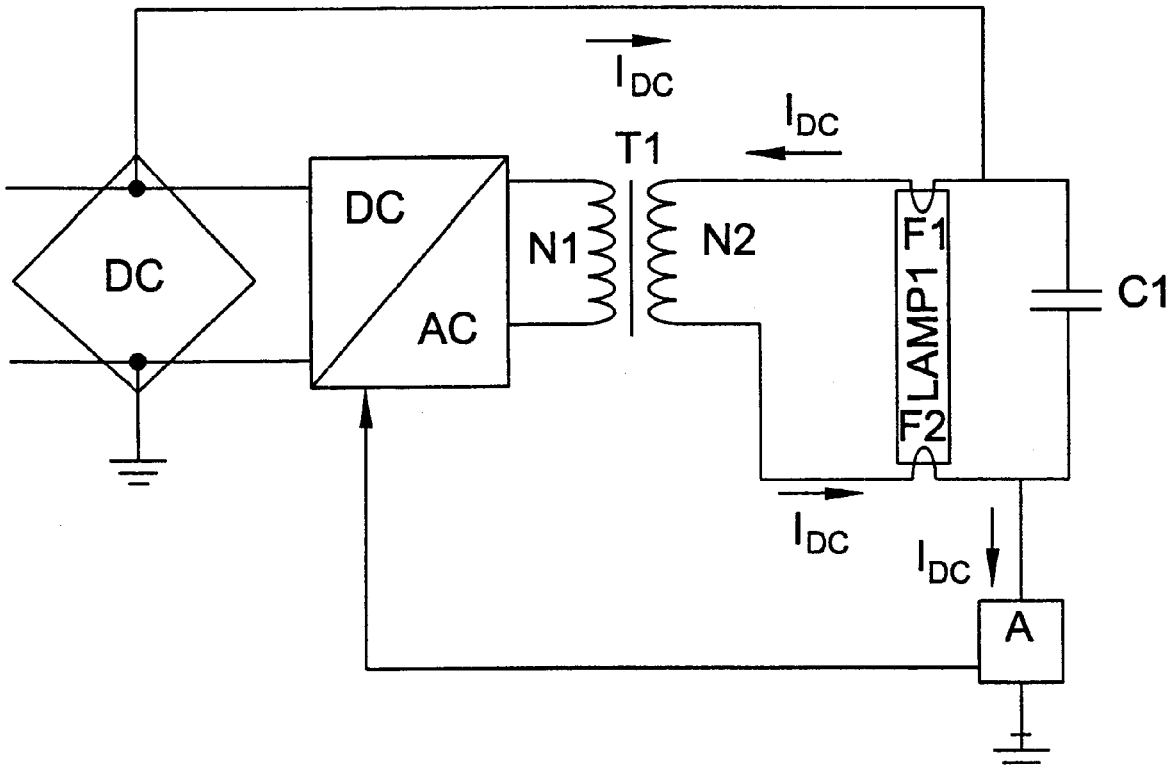
FIG.

SUPPLY COUPLING OF A FLUORESCENT LAMP

FIELD OF THE INVENTION

The invention relates to a supply coupling of a fluorescent lamp comprising a supply transformer, a resonance circuit comprising the secondary coil of the transformer and a capacitor connected in parallel with the secondary coil, and a fluorescent tube connected in parallel with the resonance circuit and comprising fluorescent cathodes. The coupling is called a lamp circuit and used for igniting and burning a fluorescent lamp. Implemented according to the present invention, the coupling is also used for supervising the condition and operation of the lamp circuit. The coupling relates particularly to a supply coupling in connection with an electronic coupling device wherein the power required by the lamp circuit is supplied to the coupling by a transformer. The main use is in coupling devices which operate at voltages below a line voltage of 230 V.

BACKGROUND OF THE INVENTION

Fluorescent lamps are generally used owing to their good lighting power. In addition, the long operating life of fluorescent lamps and the various tones of colour available enable their use in various applications.

Burning fluorescent lamps requires a supply coupling to supply the required ignition voltage to a lamp circuit and the supply voltage required during use. The problem with the current, known supply couplings in connection with lamp circuits is that when a fluorescent lamp or a lamp circuit is damaged, it is impossible to automatically switch off a supply transformer but the supply transformer continues to supply power to the lamp circuit until it is switched off manually. When the coupling is in operation again, the supply transformer has to be switched on again manually.

BRIEF DESCRIPTION OF THE INVENTION

An object of the invention is to provide a supply coupling for fluorescent lamps to avoid the aforementioned drawbacks and to enable a lamp circuit to operate properly and the condition of the lamp circuit to be controlled such that the supply coupling can be switched on or off automatically independently of the working condition of the lamp circuit. This object is achieved by a supply coupling of the invention, which is characterized in that the coupling further comprises a direct-current supply arranged to supply direct current through a circuit comprising a first fluorescent cathode of the fluorescent tube, a secondary coil of the supply transformer, a second fluorescent cathode of the fluorescent tube and an indicator circuit arranged to detect the presence of said direct current and to generate a signal indicating that presence to be used for controlling a coupling device of the fluorescent lamp.

The invention is based on the idea that by supplying a low direct current to the supply coupling by the direct-current supply, the direct current being run through the galvanically-coupled components of the coupling, the intactness and operation of the components of the coupling can be controlled by measuring the presence of the current run through the coupling by the indicator circuit connected to the coupling. When the coupling is in working order in an ordinary operating situation, the direct current running through the coupling and measured by the indicator circuit is according to a predetermined value supplied to the coupling by the direct-current supply. If the coupling is damaged, in which case its resistance increases and the current decreases correspondingly, or stops running, the signal indicating the presence of direct current and being generated by the indicator circuit connected to the coupling can be used to generate a control signal, which is preferably a current or voltage signal. The coupling device, then, controlled by the control signal, automatically switches off the power supply from the supply transformer to the lamp circuit.

Similarly, after a damaged coupling starts working again after being fixed and the direct current supplied by the direct-current supply to the coupling starts running through the coupling again, the signal indicating the presence of direct current and being generated by the indicator circuit can be used to generate a control signal, which is preferably a current or voltage signal. The coupling device, then, controlled by the control signal, automatically switches on the power supply from the supply transformer to the lamp circuit.

The coupling device of the invention provides considerable advantages as far as controlling the condition, safety, usability and power consumption of supply couplings are concerned since a damaged lamp circuit is switched off and on again automatically depending on the condition of the supply coupling. In connection with changing lamps when, for example, a damaged fluorescent tube is replaced, the lamp will be switched on automatically with no need to re-introduce the lamp circuit into operation manually.

BRIEF DESCRIPTION OF THE DRAWINGS

The invention is now described in closer detail in connection with a preferred embodiment of the invention and with reference to the accompanying drawing, in which The FIGURE shows a supply coupling of a lamp circuit which is coupled to a transformer and wherein direct current IDC exploring the condition and operation of the coupling is supplied thereto.

DETAILED DESCRIPTION OF THE INVENTION

The FIGURE shows a supply coupling of the invention comprising a lamp circuit comprising a fluorescent lamp Lamp1. At both ends of the fluorescent lamp Lamp1 are provided fluorescent cathodes F1 and F2 characteristic of a fluorescent tube. In the FIGURE, a capacitor C1 and a supply transformer T1, through which the power required for igniting and burning the lamp circuit is supplied thereto, are coupled in parallel with the fluorescent lamp Lamp1. The leakage inductance of a secondary coil N2 of the supply transformer T1 and the capacitor C1 combine to form a resonance circuit in order to generate an ignition voltage needed to ignite the fluorescent lamp Lamp1.

The coupling also comprises a direct-current supply DC located at the primary side of a coupling device and an indicator circuit A located at the secondary side of the coupling device. The direct-current supply DC is coupled to the lamp circuit in such a manner that direct current $I_{DC}$ supplied by the direct-current supply DC runs through a circuit comprising the first cathode F1 of the fluorescent lamp Lamp1, the secondary coil N2 of the supply transformer T1, the second cathode F2 of the fluorescent lamp Lamp1 and the indicator circuit A.

The supply coupling shown by the FIGURE operates in such a manner that when the lamp circuit is in operation, a low direct current $I_{DC}$, which is run through the galvanically-coupled components of the coupling, i.e. the first cathode F1 of the fluorescent lamp Lamp1, the secondary coil N2 of the supply transformer T1, the second cathode F2 of the fluorescent lamp Lamp1, is supplied to the supply coupling by the direct-current supply DC. The indicator circuit A comprises a current measuring part to explore the presence of direct current $I_{DC}$. The indicator circuit A generates a signal indicating the presence of direct current $I_{DC}$ which is used to control the coupling device of the fluorescent lamp.

If the coupling is in a normal working condition, i.e. the circuitry and the fluorescent lamp Lamp1 are intact, the indicator circuit A detects that direct current $I_{DC}$ is present, i.e. runs normally through the coupling. In such a case, the indicator circuit A generates a signal indicating the presence of direct current $I_{DC}$. The signal is a current or voltage signal by which the coupling device of the fluorescent lamp is controlled to continue to supply power to the lamp circuit.

If the coupling is damaged in such a way, for example, that a conductor or a fluorescent tube of the lamp circuit is broken, the resistance of the coupling increases and the direct current $I_{DC}$ decreases correspondingly, or stops running. A control signal, which is a current or voltage signal, is then generated on the basis of the signal indicating the presence of direct current $I_{DC}$ and being generated by the indicator circuit A connected to the coupling. Controlled by the control signal, the coupling device then automatically switches off the power supply, labeled DC/AC, from the supply transformer T1 to the lamp circuit.

If the coupling is flawed in such a manner, for example, that a conductor of the lamp circuit is broken and the conductor is fixed, the resistance of the coupling then decreases to its characteristic level when in normal operation and, correspondingly, direct current $I_{DC}$ starts running through the coupling again. A control signal, which is a current or voltage signal, is then generated on the basis of the signal indicating the presence of direct current $I_{DC}$ and being generated by the indicator circuit A connected to the coupling. Controlled by the control signal, the coupling device then automatically switches the power supply DC/AC from the supply transformer T1 to the lamp circuit.

The primary side and the secondary side of the coupling device in the embodiment described herein are galvanically connected. The power required by the indicator circuit A can alternatively be supplied from the primary side to the secondary side of the transformer T1 also by a separate transformer, and the control signal can be supplied from the indicator circuit A to the coupling device through, for example, an opto-isolator, whereby the galvanic separation is retained between the circuits.

It is obvious to those skilled in the art that the basic idea of the invention can be implemented in many different ways. The invention and its embodiments are thus not restricted to the above-described examples only but they can vary within the scope of the claims.

What is claimed is:

1. A supply coupling of a fluorescent lamp comprising a supply transformer (T1), a resonance circuit comprising a secondary coil (N2) of the transformer (T1) and a capacitor (C1) connected in parallel with the secondary coil (N2), and a fluorescent tube (Lamp1) connected in parallel with the resonance circuit and comprising fluorescent cathodes (F1, F2), the coupling further comprising a direct-current supply (DC) arranged to supply direct current (IDC) through a circuit comprising the first fluorescent cathode (F1) of the fluorescent tube, the secondary coil (N2) of the supply transformer (T1), the second fluorescent cathode (F2) of the fluorescent tube (Lamp1) and an indicator circuit (A) arranged to detect the presence of said direct current (IDC) and to generate a signal indicating that presence to be used for controlling the coupling device of the fluorescent lamp.

2. A supply coupling as claimed in claim 1, wherein the signal indicates the presence of said direct current ($I_{DC}$), the signal being generated by the indicator circuit (A) being a current or voltage signal.

* * * * *